US006912744B2

(12) United States Patent
Lyons

(10) Patent No.: US 6,912,744 B2
(45) Date of Patent: Jul. 5, 2005

(54) SUSPENDED FURNITURE ASSEMBLY

(76) Inventor: Beaumont Gregory Lyons, 109 Arrabi Ave., Mt. Ommanery, Queensland 4074 (AU)

( * ) Notice: Subject to any disclaimer, the term of this patent is extended or adjusted under 35 U.S.C. 154(b) by 0 days.

(21) Appl. No.: 10/367,921

(22) Filed: Feb. 19, 2003

(65) Prior Publication Data

US 2004/0160098 A1 Aug. 19, 2004

(30) Foreign Application Priority Data

Feb. 15, 2002 (AU) ..... PS 0567

(51) Int. Cl.[7] ..... A45F 3/22
(52) U.S. Cl. ..... 5/122; 5/127
(58) Field of Search ..... 5/120, 122, 123, 5/127, 129

(56) References Cited

U.S. PATENT DOCUMENTS

| | | | | | |
|---|---|---|---|---|---|
| 142,327 | A | | 9/1873 | Craft | |
| 201,074 | A | * | 3/1878 | Wheeler | 5/127 |
| 210,037 | A | * | 11/1878 | Howe | 5/129 |
| 292,204 | A | * | 1/1884 | Cook | 5/128 |
| 498,542 | A | * | 5/1893 | Fellowes | 5/123 |
| 816,340 | A | * | 3/1906 | Knoernschild | 5/129 |
| 856,315 | A | * | 6/1907 | Thomson | 5/129 |
| 3,321,780 | A | * | 5/1967 | Morris | 5/122 |
| 4,925,138 | A | | 5/1990 | Rawlins | |
| 5,659,906 | A | | 8/1997 | Nickell et al. | |
| 5,729,845 | A | * | 3/1998 | Hsu | 5/120 |

* cited by examiner

*Primary Examiner*—Peter R. Brown
(74) *Attorney, Agent, or Firm*—Young & Thompson

(57) ABSTRACT

A suspended furniture assembly includes a suspended chair assembly and a suspended hammock assembly. The suspended chair assembly comprises a chair including a back support, a bottom support and arm support members, suspended from a chair suspension frame assembly by suspension elements, the chair suspension frame assembly including opposed laterally spaced horizontally extending front and rear base frame members, an upstanding frame member at each side of respective base frame members, and laterally extending vertically spaced upper and lower frame members and connecting opposed front and rear upstanding members on respective assembly sides. The chair is suspended on respective sides from the chair suspension frame assembly by suspension elements connected to the lateral frame members. The suspended hammock assembly comprises a frame assembly having a base frame comprising a first longitudinal frame member and parallel thereto, a frame member, a hammock strung between hammock support elements.

12 Claims, 7 Drawing Sheets

SUSPENDED FURNITURE ASSEMBLY

FIELD OF THE INVENTION

THIS invention relates to a suspended furniture assembly comprising a chair or hammock suspended from an upstanding support frame assembly.

BACKGROUND OF THE INVENTION

Hammocks, hanging or swinging chairs and similar furniture are necessarily suspended from a suitable support(s) in use.

In terms of the requisite suspension, the prior art offers a number of different solutions for such furniture, however, there are various disadvantages with these.

In the case of hammocks, these are typically suspended between two upright supports which may include tree trunks, fence posts, walls or the like. However, the typical manner of attachment of the respective ends of the hammock to the supports does not provide much stability because of the excessive swing potential afforded to the hammock. Furthermore, as usage of the hammock is dependent on the availability and location of the supports, this manner of suspension may be inconvenient, limited and fixed to certain locations.

As an alternative, and particularly when used inside a home, on porches, balconies, patios or the like, hammocks and hanging/swinging chairs are often suspended from fixed support surfaces such as wall studs and ceiling beams. Alternatively, in outdoor usage, the hammock or hanging/swinging chair may be suspended from tree trunks, tree branches or the like. These means of suspension can, however, be cumbersome, particularly as appropriate tools and hardware are required to fix the position of the hammock or chair. Moreover, safety is a particular concern since the support structure/surface from which the hammock or chair is suspended may not be sufficiently strong to support the weight of said furniture in use, and furthermore, wear or failure can result. This also impinges on hammock or chair usability since swinging or spinning motion in the use of the hammock or chair would exacerbate safety risks. Additionally, the integrity or appearance of the support structure/surface may be compromised by the mere placement and suspension of the hammock or chair and more especially as a consequence of wear or failure. Further still, the positioning of the hammock or chair is somewhat fixed.

Whilst stands as an alternative means for the support and suspension of hammocks or chairs are disclosed in the art, known prior art solutions in respect of stands and furniture assemblies still have some shortcomings. These shortcomings relate particularly to: the bulky size and substantial weight of the support stand and furniture assembly; comfort; ergonomic design; control of lateral chair motion; portability of the furniture assembly; aesthetic appeal; and/or limited indoor or outdoor usage.

PURPOSE OF INVENTION

It is therefore the purpose of the invention to alleviate at least to some extent one or more of the aforementioned problems of the prior art and/or to provide the relevant public with a suitable alternative thereto having relative advantages.

OUTLINE OF THE INVENTION

In one aspect therefore the present invention relates to a suspended chair assembly comprising:

a chair including a back support member, a bottom support member and arm support members; and a chair suspension frame assembly including opposed laterally spaced horizontally extending front and rear base frame members, an upstanding frame member at each side of respective said base frame members, and laterally extending vertically spaced apart upper and lower frame members connecting opposed front and rear upstanding frame members on respective assembly sides;

wherein said chair is suspended on respective chair sides from said chair suspension frame assembly by suspension means connected to said lateral frame members.

In preference, said chair further includes a foot support member. Suitably, said foot support member extends horizontally substantially parallel to and below said chair bottom member. Preferably, the foot support member is suspended from said chair, most preferably at each side of said foot support member from an underside of each respective arm support member there above.

In preference, the chair is suspended by suspension means supported on respective sides by said upper frame members and anchored on respective sides to said lower frame members.

In preference, the suspension means includes one or more cords extending from each chair side. Suitably, said one or more cords include at least one cord joined at one end thereof to the side of the chair back member, suitably proximal to an upper end thereof. More preferably, a plurality of cords are joined at each side to said chair back member, said plurality of cords being suitably vertically spaced apart along the side of the chair back.

In preference, each said suspension means is arranged relative to the chair suspension frame assembly so that the suspension means extends from the respective chair side over the proximal upper frame member, by which it is supported, down to said lower frame member, at which it is anchored by anchoring means, over the outermost side of said upper frame member, then down to said arm support member.

The said suspension means may either terminate at said arm support member, or, more preferably when the assembly includes a foot support member, may extend there through to be connected to said foot support member.

Suitably, the position of said suspension means relative to said arm support and/or foot support members is adjustably secured in use by means of a knot or the like formed in said suspension means at positions preferably under each of said arm and/or foot support members.

The preferred anchoring means comprises a chain and hook arrangement connected to said lateral frame member and adapted to adjustably couple said suspension means thereto.

In preference, the suspension means is securely retained on said upper frame members by use of cord stops or the like. Suitably a cord stop is positioned forward and rearward of said suspension means on each said upper chair support frame member to restrict lateral movement of said suspension means thereon. Alternatively, respective front and rear upstanding frame members of the chair suspension frame assembly can extend in height a sufficient distance beyond the height of the upper frame members for said restriction of suspension means lateral movement, in which case the use of cord stops may be superfluous.

In use, this suspension means arrangement suitably enables adjustments to be made to the height of the chair from the ground surface, the sitting angle as defined as the angle between the chair bottom and chair back, the height of the foot support member and the swing potential of the chair, said swing potential being greater when the chair height is lowered.

The chair may be manufactured from any suitable material including cotton. Suitably, said back support and bottom support members of the chair are made continuous, being formed from a single material piece. Suitably, respective arm support members are connected or joined to respective sides of said seat member. In preference, the arm and foot support members are manufactured from a rigid material such as wood or the same material as the chair suspension frame assembly. The suspension means are suitably made from cotton or nylon. The chair may further include decorative features such as ornamental fringes, comfort features including pillows and cushions, and/or functional features including a stow away table connected to the frame assembly and/or an overhead canopy for fitment on said upstanding frame members and/or upper chair support members.

The chair suspension frame assembly may be manufactured from any suitable material including metal and wood such as hardwood. Said frame assembly may be manufactured as one or more preferably multiple separate frame member pieces so that it may be assembled and/or dismantled. The frame members may be either solid or hollow in construction depending on material strength, and if hollow it may be preferable to include solid parts at joining/corner parts of the frame assembly.

Preferably, said front and rear base frame members extend at least the width of said chair bottom support. Preferably, said upstanding frame members extend at least the height of said suspended chair from a ground surface on which said frame assembly is supported. The upstanding frame members may be arranged vertically or slightly inclined from the vertical. Preferably, said upstanding frame members are outwardly inclined from said assembly base frame members. Additional frame members may be incorporated in the frame assembly design. For example, bracing frame members may be connected between the base and upstanding frame members for additional assembly strength. Alternatively, an additional lateral support/anchor frame member may be utilised.

In an alternative and further aspect therefore the present invention relates to a suspended hammock assembly comprising a frame assembly having a base frame and spaced hammock cord supports whereby a hammock can be strung between the cord supports in operative position, characterized in that the hammock cord supports are adapted to support hammock cords in spaced relation.

Preferably, the base frame comprises spaced longitudinally extending frame members adapted to be positioned below and on opposite sides of a hammock centre line, the supports comprising upstanding frame members supported by the base frame members and a cross-bar extending across an imaginary extension of the hammock centre line, the hammock cords being supported in spaced relation on said cross-bar.

Preferably, the frame assembly when viewed end on has a generally trapezium shape being wider at the base.

Preferably, the frame assembly comprises side frames connected at opposite ends by at least two cross-bars, an upper one of said at least two cross-bars providing said hammock cord support and a lower one of said cross-bars providing an anchor for hammock cords.

Preferably, the hammock cord supports have hammock cord restraining means preventing movement of said cords along said support.

Preferably, said cord supports include means for terminating and anchoring said cords at said support.

Preferably, the hammock stand includes means for anchoring said cords.

Preferably, said hammock stand includes means for anchoring said cords at a position below said supports.

BRIEF DESCRIPTION OF THE DRAWINGS

In order that the present invention can be more readily understood and put into practical effect reference will now be made to the accompanying drawings which illustrate the preferred embodiments of the invention, wherein.

DESCRIPTION OF THE PREFERRED EMBODIMENTS

Figure 1:
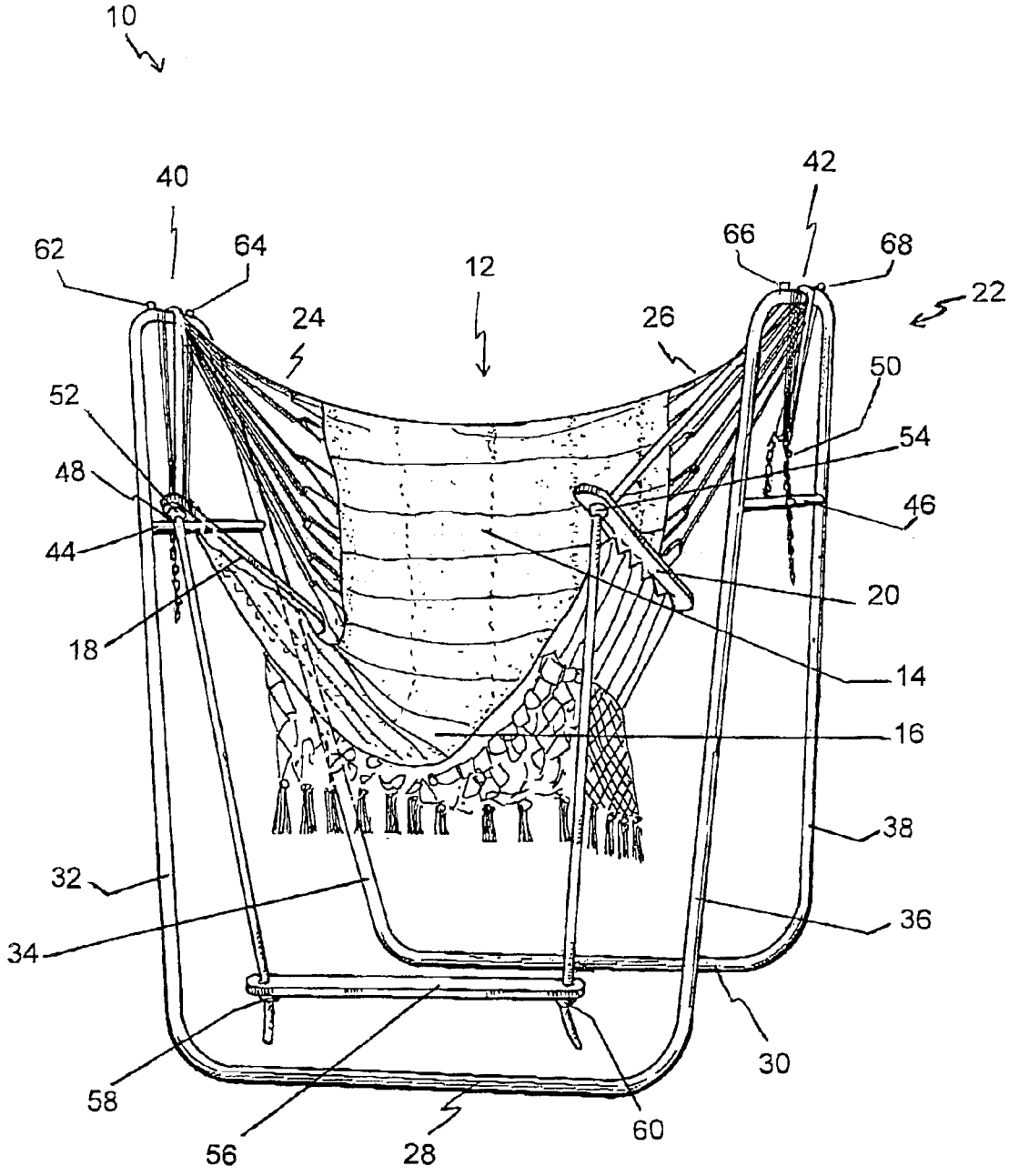
FIG. 1 is a perspective view of a suspended furniture assembly according to a first aspect of the invention comprising a suspended chair assembly.

Referring to the drawings and initially to FIGS. 1 to 8 there is illustrated a suspended furniture assembly according to a first aspect of the invention comprising a suspended chair assembly.

Figure 2:
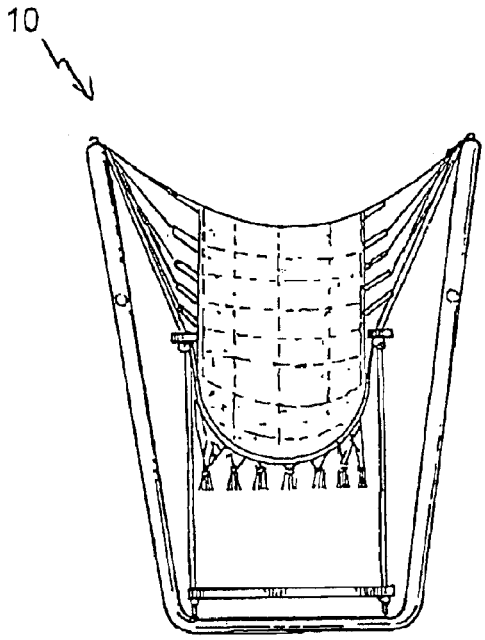
FIG. 2 is a front view of the suspended chair assembly shown in FIG. 1.
Figure 3:
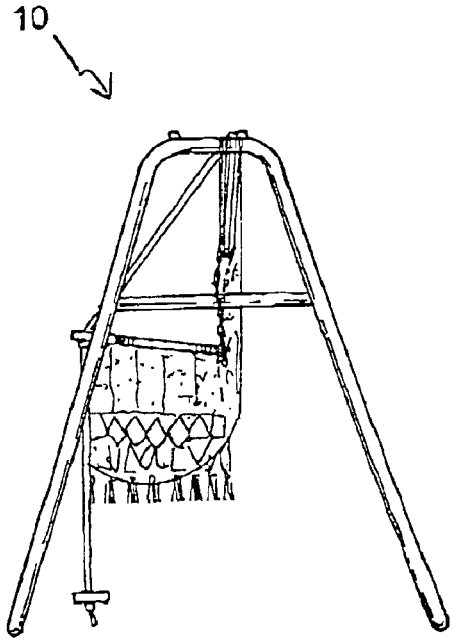
FIG. 3 is a side view of the suspended chair assembly shown in FIG. 1.
Figure 4:
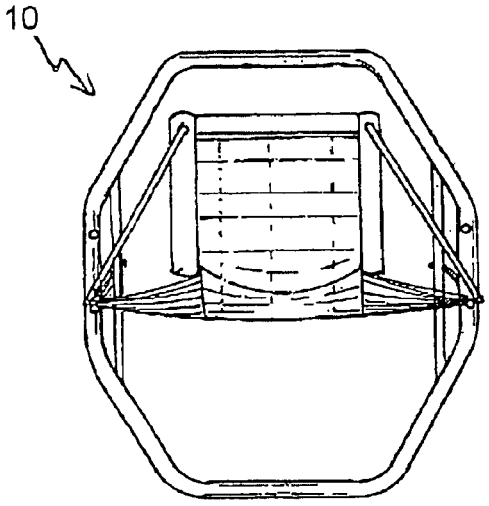
FIG. 4 is a plan view of the suspended chair assembly shown in FIG. 1.
Figure 5:
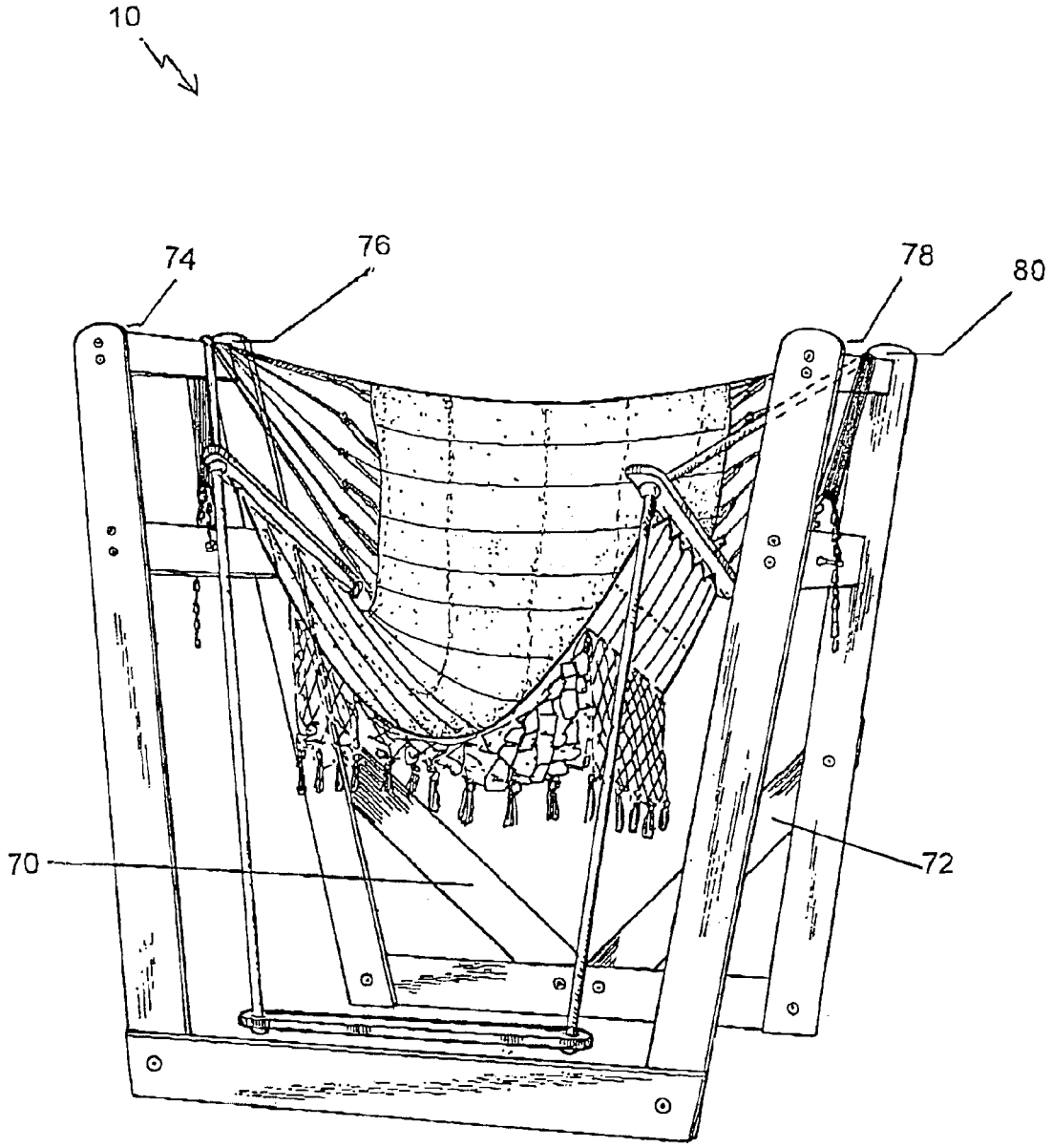
FIG. 5 is a perspective view of the suspended chair assembly according to FIG. 1 showing an alternative embodiment of the chair suspension frame assembly.
Figure 6:
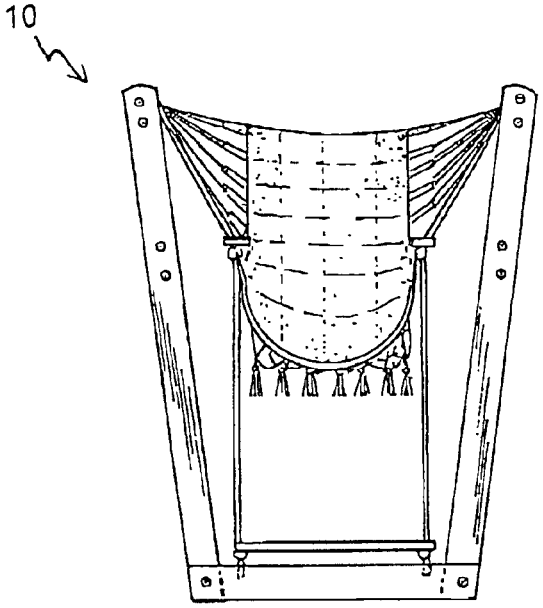
FIG. 6 is a front view of the suspended chair assembly shown in FIG. 5.
Figure 7:
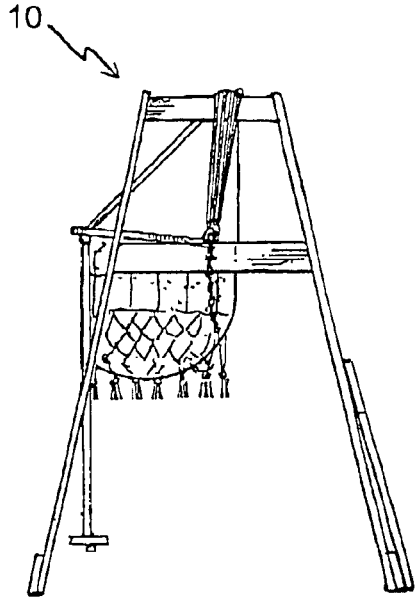
FIG. 7 is a side view of the suspended chair assembly shown in FIG. 5.
Figure 8:
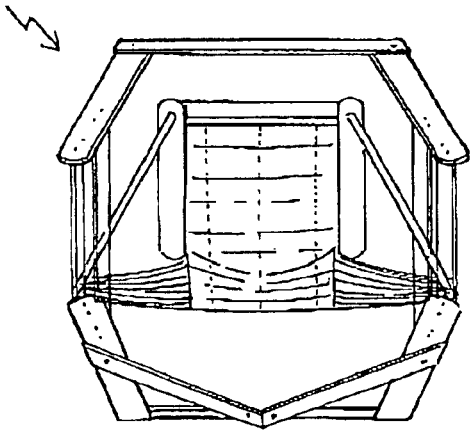
FIG. 8 is a plan view of the suspended chair assembly shown in FIG. 5.

With reference to FIG. 1, there is shown a suspended chair assembly 10 comprising a chair 12 including a back support member 14 and a bottom support member 16, formed from a continuous piece of cotton material, and arm support members 18 and 20 of wooden manufacture. The chair 12 is suspended on both chair sides from a chair suspension frame assembly 22 by respective suspension means 24 and 26. The chair suspension frame assembly 22 which is shown here to be of metal manufacture includes opposed laterally spaced horizontally extending front and rear base frame members 28 and 30 respectively, an upstanding frame member 32, 34, 36 and 38 at each side of respective said base frame members, laterally extending upper chair support frame members 40 and 42 each connecting opposed front and rear upstanding members on respective assembly sides and, vertically spaced from respective said upper chair support frame members, laterally extending lower chair anchor frame members 44 and 46. The suspension means 24 and 26, in the form of a plurality of vertically spaced apart cords, extend from the respective chair sides over the respective proximal upper chair support frame members 40 and 42 which support the chair, down to said lower chair anchor frame members 44 and 46 at which the cords are anchored by anchoring means 48 and 50 in the form of a chain and hook arrangement adjustably coupling said cords to respective lower chair anchor frame members 44 and 46, returning up the outside of and over the said upper chair support frame member 40 and 42, down to said arm support members 18 and 20 where the respective positions of the cords are secured by means of respective knots 52 and 54, then finally, through respective sides of foot support member 56, where the respective positions of the cords are secured by means of respective knots 58 and 60. The respective cord 24 and 26 positions on said upper chair support frames 40 and 42 are secured by means of cord stops 62, 64, 66 and 68. FIGS. 2 to 4 illustrate this preferred embodiment of the invention in front, side and plan views.

Referring to FIGS. 5 to 8, there is illustrated a suspended chair assembly 10 according to an alternative embodiment of said first aspect of the invention, wherein the chair suspension frame assembly 22 is manufactured from wood rather than metal. The essential difference between the formerly illustrated metal and presently illustrated timber frame assembly is in respect of the addition of braces 70 and 72 in the instant embodiment as well as the omission of the cord stops 62, 64, 66 and 68 in view of the additional height of the upstanding frame members at 74, 76, 78 and 80 which extend beyond the height of the chair support frame members 40 and 42.

The advantages of this first aspect of the invention include: adjustability; portability; safety; indoor and outdoor usage; compactness; lightweight design; aesthetic appeal; controllable swinging capacity; assemblage/dismantling capacity; and/or added features.

Figure 9:
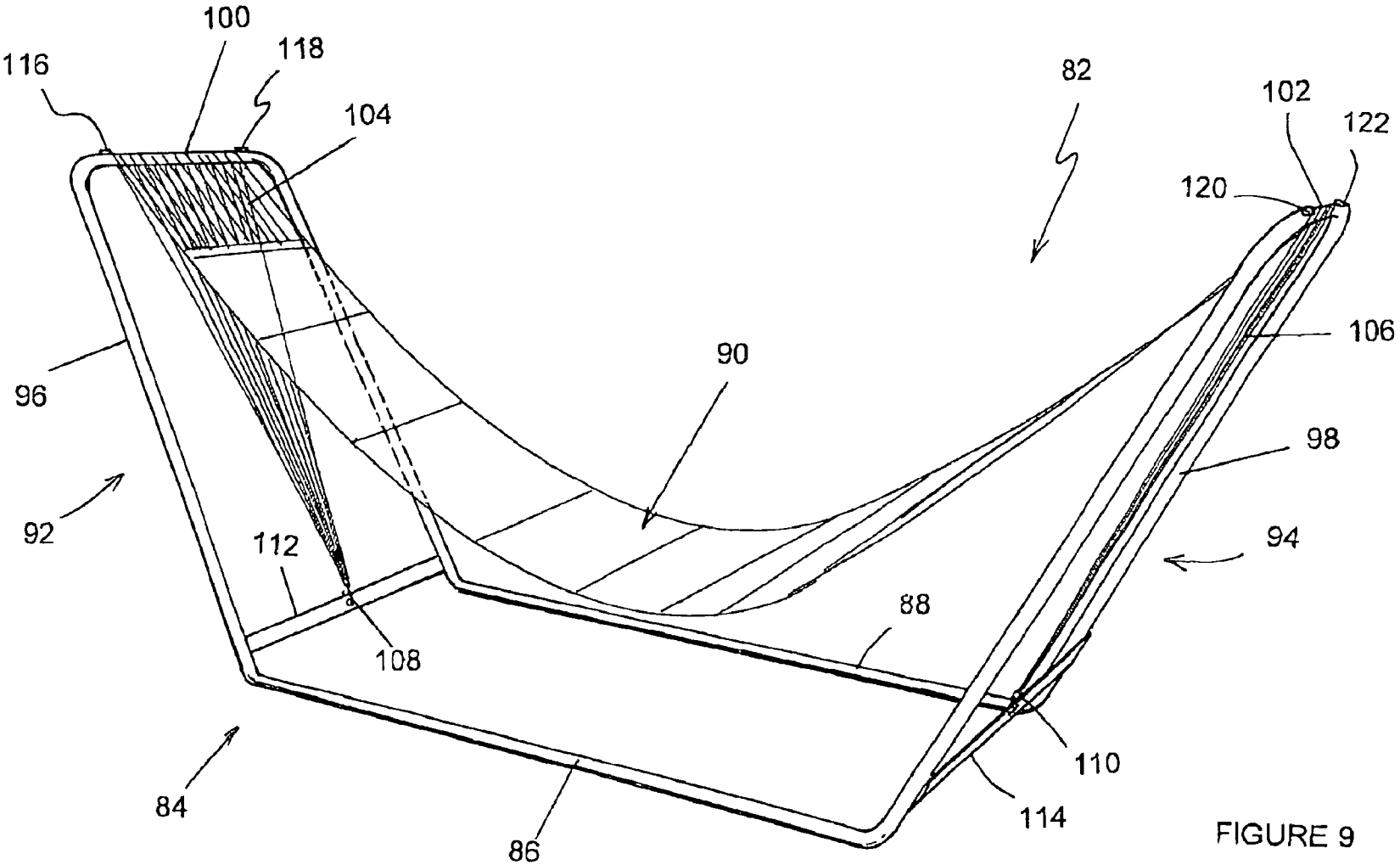
FIG. 9 is a perspective view of a suspended furniture assembly according to a further aspect of the invention comprising a suspended hammock assembly.
Figure 10:
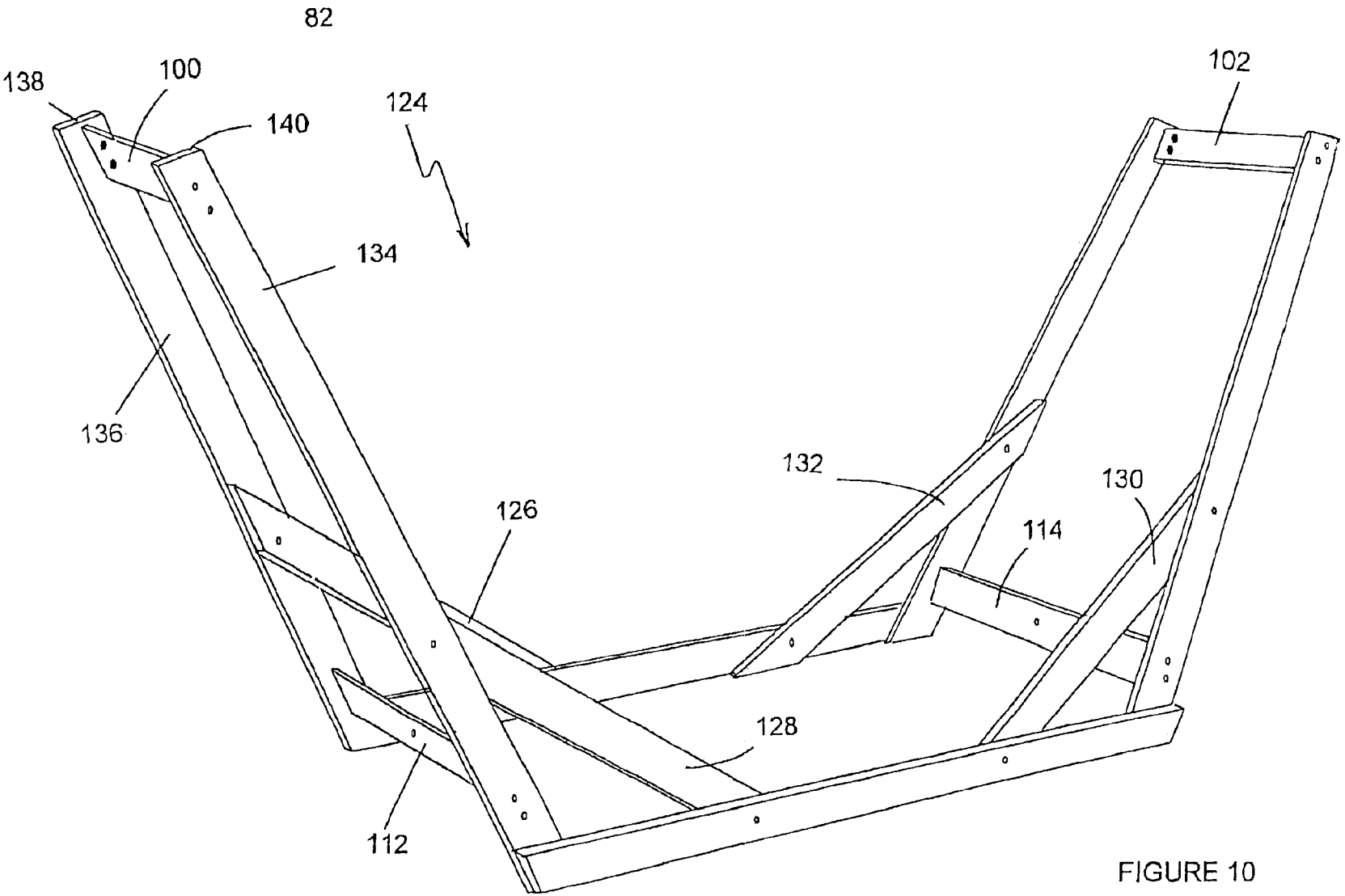
FIG. 10 is a perspective view of the suspended hammock assembly according to FIG. 9 showing an alternative embodiment.
Figure 11:
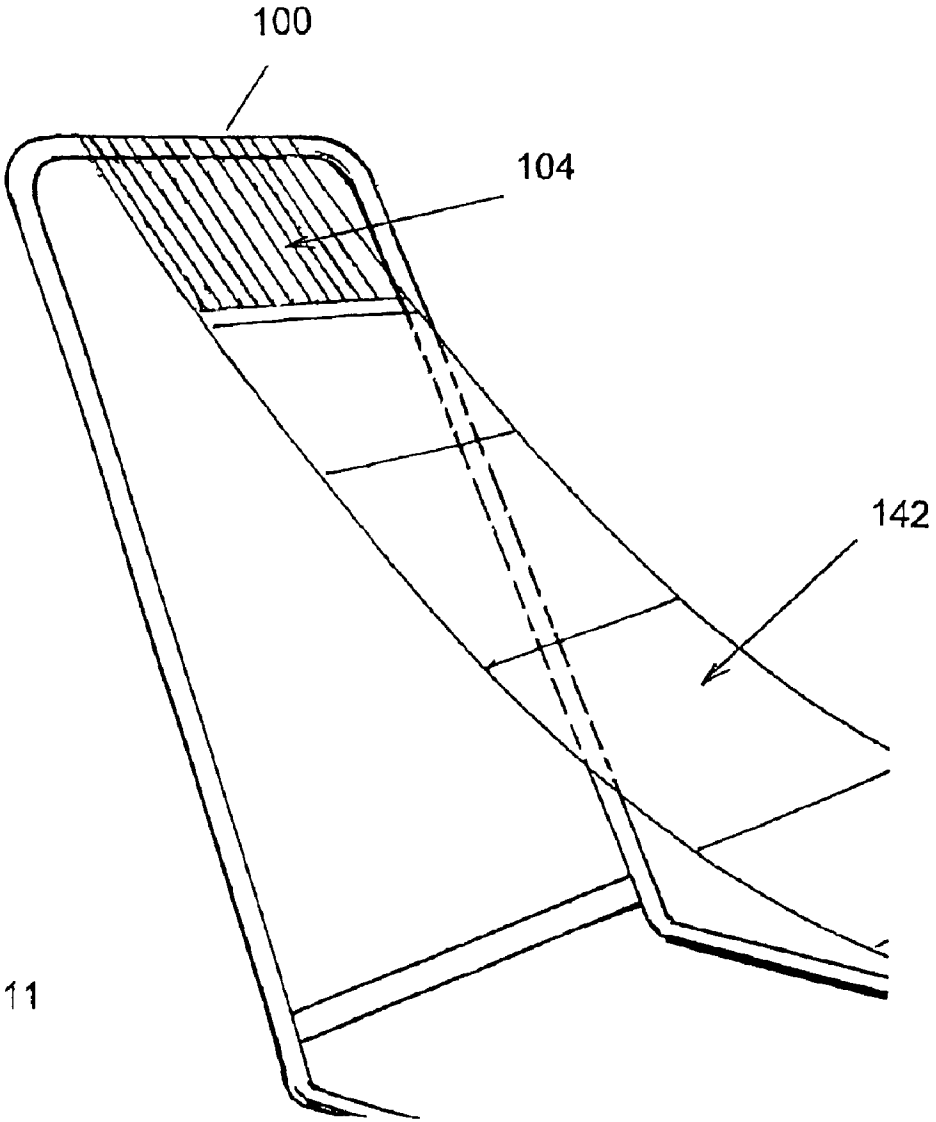
FIG. 11 is a perspective view of the suspended hammock assembly according to FIG. 9 showing an alternative embodiment.

Referring to FIGS. 9 to 11, there is illustrated a suspended furniture assembly according to an alternative and further aspect of the invention comprising a suspended hammock assembly.

As shown in FIG. 9 there is illustrated a suspended hammock assembly 82 comprising a frame assembly 84 having a base frame comprising a first longitudinal frame member 86 and a parallel thereto a frame member 88, a hammock 90 is shown strung between hammock support means 92 and 94 defined by upstanding inverted U-frame members 96 and 98. The cords are supported in spaced relation on cross-bars at 100 and 102 respectively, hammock cords being shown generally at 104 and 106 while the ends 108 and 110 of the hammock are anchored at cross-bars 112 and 114.

The end frames 92 and 94 generally converge slightly in an upward direction so that the end frames are generally trapezium shaped in end view. Cross-bars 112 and 114 not only provide anchorage for the ends 108 and 110 of the hammock 90 but also provide a bracing function securing the frame assembly 84 in a rigid yet light-weight form.

While it is typical to utilise tubular metal materials in the frame, the frame may be strengthened by including sections of solid metal within sections of the tube notably the sections of the tube where the frame assembly has been formed with corners.

The cross-bars 100 and 102 can be of any shape. As can be seen in FIG. 1 each cross-bar 100 and 102 includes spaced cord stops 116, 118, 120 and 122 to prevent cords sliding from the cross-bars.

Referring to FIG. 10 there is illustrated an alternative embodiment. Like numerals have been used to illustrate like features. The only difference in this case is that the suspended hammock assembly 124 is made from timber and the frame includes braces 126, 128, 130 and 132, the basic structure include the use of cross-bars 100 and 102, the spaced cord stops of the previous embodiment are not needed due to members 134 and 136 at 138 and 140 which function as equivalent to the stops 116 through 122 of FIG. 9.

Referring now to FIG. 11 in this embodiment a frame similar to the frame of FIG. 9 is employed but in this case the cords 104 of a hammock 142 terminate at the cross-bars, cross bar 100 being shown. Any suitable terminating means may be incorporated in the cross-bars including grommets, holes through the cross-bars through which the cords 104 are fed and retained, or any other suitable means.

Whilst the above has been given by way of illustrative example many variations and modifications thereto will be apparent to those skilled in the art without departing from the broad ambit and scope of the invention as herein set forth and as defined in the appended claims. For example, the frame assemblies may be fully dismantable, assembled from preformed clipped together pipe sections or dismantable timber sections. Similarly, the cords need not be anchored in the fashions illustrated but as an alternative the cords may be folded first over the top cross-bar/upper lateral frame member down below an intermediate bar/lateral frame member and back up and connected to the top cross-bar/upper lateral frame member. Many other variations for anchoring the cords will be apparent to those skilled in the art. The hammock illustrated in FIG. 9 is a schematic drawing only, the present invention will clearly be applicable to any of the various forms of hammocks which may be strung and utilised with the frame assembly according to the invention.

What is claimed is:

1. A suspended hammock assembly comprising a hammock having a fabric portion, hammock axis extending longitudinally and cords extending from each end of the fabric portion and a frame assembly, the frame assembly having a base frame and outwardly and axially inclined end frame members having respective hammock cord supports and hammock cord anchors, the hammock cord anchors being located below the respective cord supports whereby the hammock is strung between the supports in operative position with cords at each end of the hammock passing over the cord supports, converging and terminating at the anchors, the cord supports extending across the frame assembly either side of the hammock centre line and having bilateral cord stops to prevent cords sliding off the supports, the cords being supported on the cord supports in folded over the cord supports configuration whereby the cords assume a spaced apart relation supported by but not connected to the supports thereby allowing limited movement of cords along the support as the hammock swings and then the cords converge to a point of securement at the anchors, the base frame comprising elongate longitudinally extending ground engaging frame members extending along opposite sides of the hammock centre line and in contact with a supporting surface and the end frame members including upstanding inverted U-shaped members connected to the base frame members so that the frame assembly is generally trapezium shaped in end view.

2. A suspended hammock assembly according to claim 1, wherein the frame assembly comprises side frame members connected at opposite ends by at least two cross-bars an upper one of said at least said two cross-bars providing said hammock cord support and a lower one of said cross-bars providing said anchor for the hammock cords.

3. A suspended hammock assembly according to claim 1, wherein said bilateral cord stops on said hammock cord supports have hammock cord restraining means preventing movement of said cords along said cord support, said bilateral cord stops comprising upstanding extensions of said inverted U-shaped members.

4. A suspended hammock assembly according to claim 1, wherein said cord supports include means for terminating and anchoring said cords at said support, said means for terminating and anchoring said cords comprising a lower cross bar having a centrally located anchor point at which the cords are terminated.

5. A suspended hammock assembly according to claim 1 wherein said suspended hammock assembly includes means for anchoring said cords at a position below said supports.

6. A suspended hammock assembly according to claim 1 wherein bilateral cord stops on said cord supports comprise spaced projections.

7. A suspended hammock assembly according to claim 1 wherein the frame assembly comprises side frame members connected at opposite ends by at least two cross-bars, an upper one of said at least said two cross-bars providing said hammock cord support and a lower one of said cross-bars providing said anchor for the hammock cords, said bilateral cord stops on said hammock cord supports have hammock cord restraining means preventing movement of said cords along said cord support, said bilateral cord stops comprising upstanding extensions of said inverted U-shaped members.

8. A suspended hammock assembly according to claim 1 wherein the frame assembly comprises side frame members connected at opposite ends by at least two cross-bars, an upper one of said at least said two cross-bars providing said hammock cord support and a lower one of said cross-bars providing said anchor for the hammock cords and said bilateral cord stops on said cord supports comprise spaced projections.

9. A suspended hammock assembly according to claim 1 wherein the frame assembly comprises side frame members connected at opposite ends by at least two cross-bars forming said end frame members, an upper one of said at least two cross-bars providing said hammock cord support and a lower one of said cross-bars providing said anchor for the hammock cords, each end frame having a lower portion extending into the base frame and the lower one of said two cross bars being located at the lower portion of said end frame members so that a major portion of said cords are positioned between the upper and lower cross bars.

10. A suspended hammock assembly according to claim 1 wherein the frame assembly comprises side frame members connected at opposite ends by at least two cross-bars, an upper one of said at least said two cross-bars providing said hammock cord support and a lower one of said cross-bars providing said anchor for the hammock cords, said bilateral cord stops on said hammock cord supports have hammock cord restraining means preventing movement of said cords along said cord support, said bilateral cord stops comprising upstanding extensions of said inverted U-shaped members and said frame assembly is longitudinally and laterally symmetrical.

11. A suspended hammock assembly according to claim 1 wherein the frame assembly comprises side frame members connected at opposite ends by at least two cross-bars, an upper one of said at least said two cross-bars providing said hammock cord support and a lower one of said cross-bars providing said anchor for hammock cords and said bilateral cord stops on said cord supports comprise spaced projections and said frame assembly is longitudinally and laterally symmetrical.

12. A suspended hammock assembly according to claim 1 wherein the frame assembly comprises side frame members connected at opposite ends by at least two cross-bars forming said end frame members,n an upper one of said at least two cross-bars providing said anchor hammock cord support and a lower one of said cross-bars providing said anchor for the hammock cords, each end frame having a lower portion extending into the base frame and the lower one of said two cross bars being located at the lower portion of said end frame members so that a major portion of said cords are positioned between the upper and lower cross bar and said frame assembly is longitudinally and laterally symmetrical.

* * * * *